United States Patent [19]

McCartney

[11] 4,252,069

[45] Feb. 24, 1981

[54] LOW LOAD COAL BUCKET

[75] Inventor: Michael S. McCartney, Bloomfield, Conn.

[73] Assignee: Combustion Engineering, Inc., Windsor, Conn.

[21] Appl. No.: 29,605

[22] Filed: Apr. 13, 1979

[51] Int. Cl.[3] ..... F23K 3/02

[52] U.S. Cl. ..... 110/104 B; 110/261; 110/265; 239/587

[58] Field of Search ..... 110/261–263, 110/265, 232, 347, 348, 113, 114, 101 CF, 106, 104 B; 122/479 R; 239/587, 565, 391

[56] References Cited

U.S. PATENT DOCUMENTS

| | | | |
|---|---|---|---|
| 819,602 | 5/1906 | Rupp | 239/587 |
| 1,011,934 | 12/1911 | Fellows | 239/587 |
| 1,949,277 | 2/1934 | Jackson | 110/263 |
| 1,957,965 | 5/1934 | Kennedy et al. | 110/263 |
| 2,363,875 | 11/1944 | Kreisinger et al. | 110/263 |
| 2,608,168 | 8/1952 | Jackson | 431/176 |
| 2,800,888 | 7/1957 | Miller et al. | 110/261 |
| 2,895,435 | 7/1959 | Bogot et al. | 239/587 |
| 4,173,189 | 11/1979 | Cooper | 110/263 |

*Primary Examiner*—Henry C. Yuen

*Attorney, Agent, or Firm*—William W. Habelt

[57] ABSTRACT

An improved fuel-air admission assembly incorporating a split coal bucket which permits a pulverized coal-fired furnace to be operated at low loads without the use of auxiliary fuel to provide stabilization. The split coal bucket comprises an upper and a lower coal nozzle pivotally mounted to the coal delivery pipe, the upper and lower coal nozzles being independently tiltable. When the furnace is operating at low loads, the primary air and pulverized coal stream discharging from the coal delivery pipe is split into a first and a second coal-air stream and independently directed into the furnace by tilting at least one of the nozzles away from the longitudinal axis of the coal delivery pipe, thereby establishing an ignition stabilizing pocket in the locally low pressure zone created between the spread apart coal-air streams.

4 Claims, 7 Drawing Figures

LOW LOAD COAL BUCKET

BACKGROUND OF THE INVENTION

The present invention relates to pulverized coal-fired furnaces and, more particularly, to improving the low load operation of fuel burners employed therein.

In view of today's fluctuating electricity demand, typified by peak demand occurring during weekday daytime hours and minimum demand occurring at night and on the weekends, electric utilities have chosen to cycle many of their conventional coal-fired steam generator boilers by operating them at full load during peak demand hours and reducing them to low loads during periods of minimum demand.

As a consequence of this mode of operation, the electric utilities have used large quantities of natural gas or oil to furnish additional ignition energy during low load operation because the current generation of coal-fired steam generator furnaces require stabilization of the coal flames when operating at low loads. The required amount of auxiliary fuel fired for stabilization pruposes is significant and, for example, to maintain a 500 megawatt coal-fired steam generator at 10 to 15 percent load during minimum demand periods would require the use of 450 gallons of oil per hour.

One common method of firing coal in conventional coal-fired steam generator boilers is known as tangential firing. In this method, pulverized coal is introduced to the furnace in a primary air stream through burners, termed fuel-air admission assemblies, located in the corners of the furnace. The fuel-air streams discharged from these burners are aimed tangentially to an imaginary circle in the middle of the furnace. This creates a fireball which serves as a continuous source of ignition for the incoming coal. More specifically, a flame is established at one corner which in turn supplies the required ignition energy to stabilize the flame emanating from the corner downstream of and laterally adjacent to it. When load is reduced, the flames emanating from each corner become shorter and, as a consequence, a reduction in the amount of ignition energy available to the downstream corner occurs. As a result, auxiliary fuel such as oil or natural gas must be introduced in each corner adjacent to the pulverized coal-air stream to provide additional ignition energy thereby insuring that a flameout and resultant unit trip will not occur.

Another problem associated with operating a coal-fired burner at low load results from the fact that the pulverizing mills typically operate with a fairly constant air flow over all load ranges. When furnace load is reduced, the amount of coal pulverized in the mills decreases proportionally while the amount of primary air used to convey the pulverized coal from the mills through the admission assemblies into the furnace remains fairly constant. Consequently, the fuel-air ratio decreases. When the load on the furnace is reduced to the low levels desired during minimum demand periods, the fuel-air ratio has decreased to the point where the pulverized coal-primary air mixture has become too fuel lean for ignition to stabilize without significant supplemental ignition energy being made available.

Accordingly, it is an object of the present invention to provide for stabilized ignition of pulverized coal flames in pulverized coal-fired steam generators operating at low load without firing auxiliary fuels such as natural gas or oil.

SUMMARY OF THE INVENTION

The present invention provides an improved fuel-air admission assembly incorporating a split coal bucket which permits a pulverized coal-fired furnace and, more specifically, a pulverized coal-fired furnace employing the tangential firing method, to be operated at low loads without the use of auxiliary fuel to provide stabilization.

In accordance with the invention, the split coal bucket comprises an upper and a lower coal nozzle pivotally mounted to the coal delivery pipe, the upper and lower coal nozzles being independently tiltable. When the furnace is operating at low loads such as during the minimum demand periods, the primary air and pulverized coal stream discharging from the coal delivery pipe is split into an upper and a lower coal-air stream and independently directed into the furnace by tilting at least one of the nozzles away from the longitudinal axis of the coal delivery pipe. In doing so, an ignition stabilizing pocket is established in the locally low pressure zone created between the spread apart coal-air streams. Hot combustion products are drawn, i.e., recirculated, into this low pressure zone, thus providing enough additional ignition energy to the incoming fuel to stabilize the flame.

Ignition stability is further improved by the fact that as the upper and lower coal-air streams split, the coal in the upper coal-air stream tends to concentrate along the lower surface of the upper coal-air stream as a result of the density differential between the coal and the air and the centrifugal forces generated as the upper coal-air stream is turned upward. Similarly, the coal in the lower coal-air stream tends to concentrate along the upper surface of the lower coal-air stream as the lower coal-air stream turns downward when passing through the lower coal nozzle. Since the lower surface of the upper coal-air stream and the upper surface of the lower coal-air stream border upon the ignition stabilizing zone established therebetween, the concentrated coal will be drawn into the ignition stabilizing zone thereby increasing the local fuel-air ratio and, accordingly, reducing the energy requirements for stabilizing ignition.

DESCRIPTION OF THE PREFERRED EMBODIMENT

Figure 1:
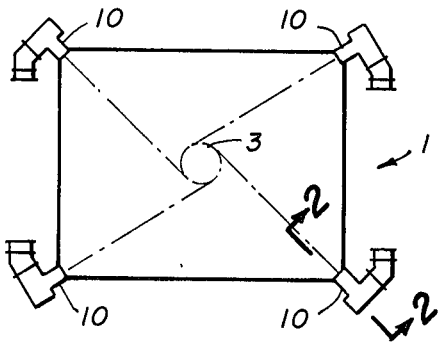
FIG. 1 is a diagrammatic plan view of a furnace employing the tangential firing method.

While the present invention may be applied, in spirit and in scope, to a number of different firing methods employed in conventional pulverized coal-fired steam generator boiler furnaces, it may be best described when embodied in a pulverized coal-fired furnace employing the tangential firing method as illustrated in FIG. 1. In the tangential firing method, fuel and air are introduced to the furnace through fuel-air admission assemblies 10 mounted in the four corners of furnace 1. The fuel-air admission assemblies 10 are orientated so as to deliver the pulverized coal and air streams tangentially to an imaginary circle 3 in the center of furnace 1 so as to form a rotating vortex-like flame termed a fireball therein.

Figure 2:
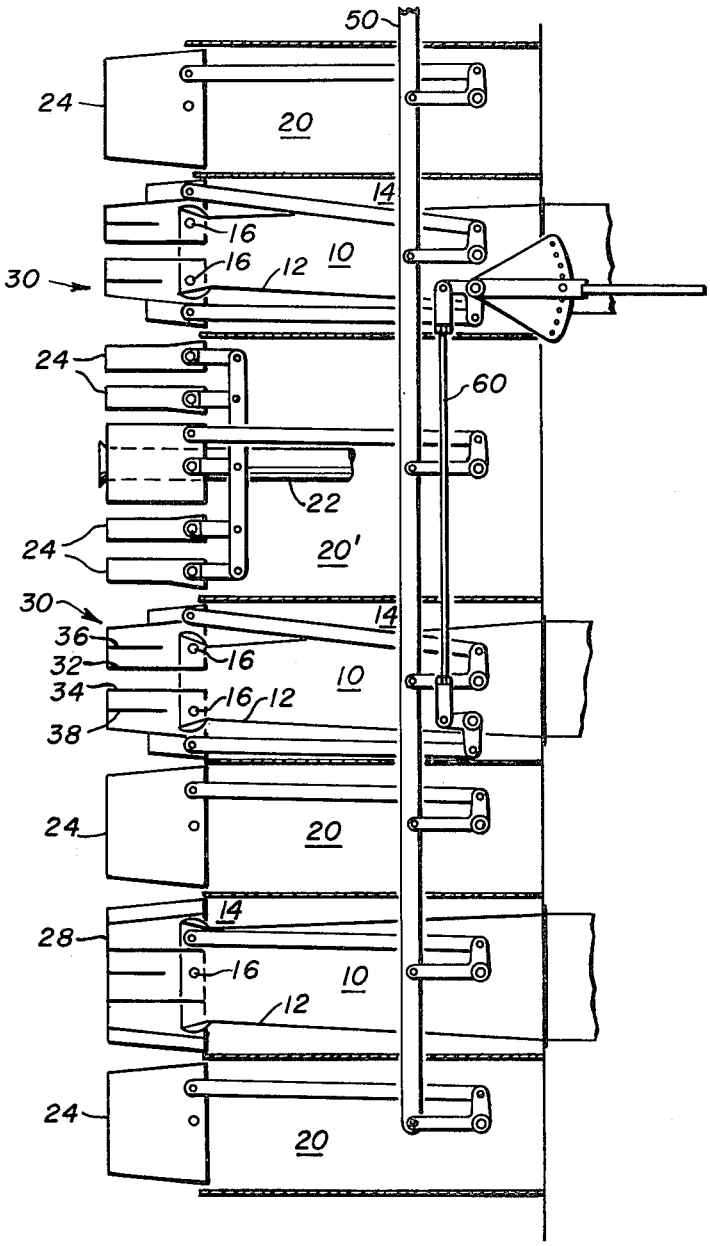
FIG. 2 is an elevational cross-sectional view, taken along line 2—2 of FIG. 1, of a set of three fuel-air admission assemblies, the upper two assemblies having a split coal bucket designed in accordance with the present invention and the lower assembly equipped with a coal bucket typical of the prior art.
Figure 3:
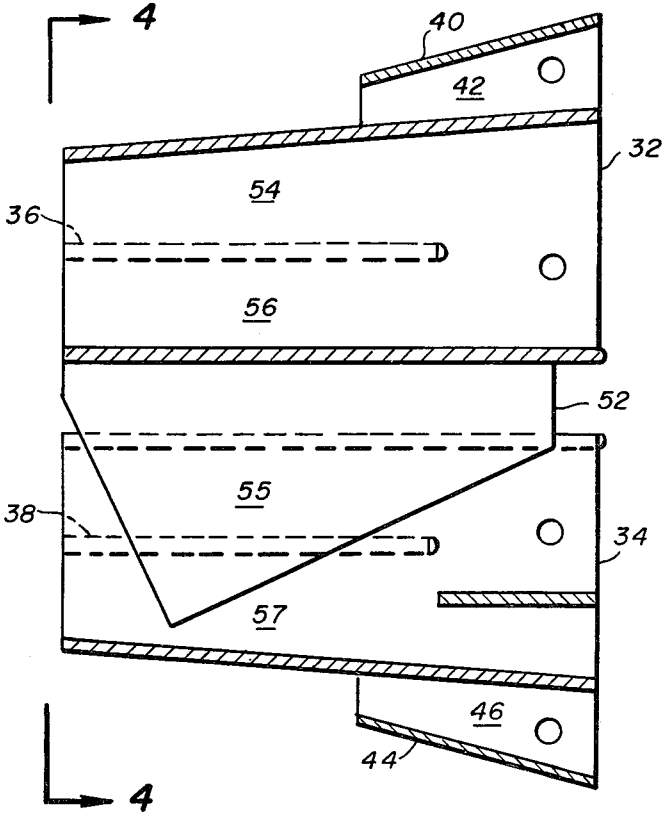
FIG. 3 is an elevational cross-sectional view of a single fuel-air admission assembly equipped with a split coal bucket designed in accordance with the present invention with the coal nozzles orientated in the normal full load operating position.
Figure 4:
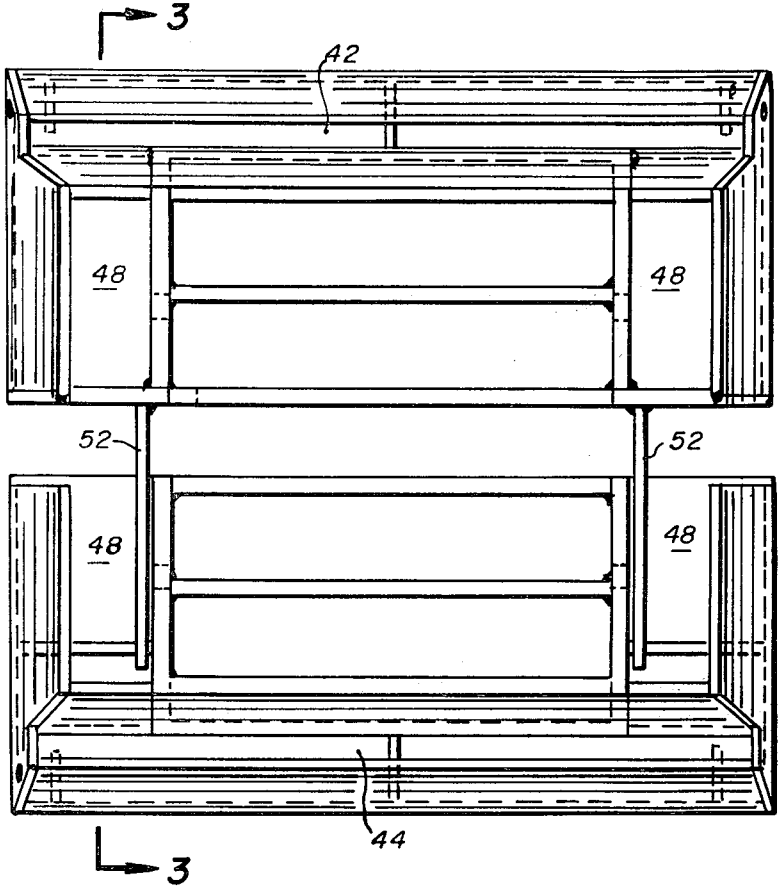
FIG. 4 shows an elevational cross-sectional view of a fuel-air admission assembly equipped with a split coal-air bucket designed in accordance with the present invention with the coal nozzles tilted apart for stable low load operation.

As shown in FIG. 2, a plurality of fuel-air admission assemblies 10 are arranged in the corners in a vertical column separated by auxiliary air compartments 20 and 20'. One or more of these auxiliary air compartments, such as compartment 20', is adapted to accommodate an auxiliary fuel burner, which is used when starting and warming up the boiler and which may be used when necessary to provide additional ignition energy to stabilize the coal flame when operating at low loads.

Each fuel-air admission assembly 10 comprises a coal delivery pipe 12 extending therethrough and opening into the furnace, and a secondary air conduit 14 which surrounds coal delivery pipe 12 and provides a flow passage so that the secondary air may be introduced into the furnace as a stream surrounding the primary air-pulverized coal stream discharged from coal delivery pipe 12. Each coal delivery pipe 12 is provided with a tip, termed a coal bucket, which is pivotally mounted to the coal delivery pipe 12 so that the coal bucket may be tilted about an axis 16 transverse to the longitudinal axis of coal delivery pipe 12.

A typical prior art single nozzle coal bucket 28 is shown in FIG. 2 mounted to the coal delivery pipe of the lower fuel-air admission assembly. Coal bucket 28 can be tilted upward or downward about axis 16 in order to direct the pulverized-coal primary air mixture into the furnace at an upward or downward angle as a means of controlling the position of the fireball within the furnace as a means of controlling the temperature of the superheated steam leaving the generator (not shown) in the manner taught by U.S. Pat. No. 2,363,875 issued Nov. 28, 1944, to Kreisinger et al for "Combustion Zone Control".

In accordance with this invention, coal bucket 28 is replaced with a split coal bucket 30 shown in FIG. 2 pivotally mounted to the coal delivery pipes 12 of the upper two fuel-air admission assemblies. Each split coal bucket 30 comprises an upper coal nozzle 32 and a lower coal nozzle 34, both of which are independently tiltable about axis 16 transverse to the longitudinal axis of coal delivery pipe 12. By tilting the upper coal nozzle 32 upward, a first portion of the primary air and pulverized coal mixture discharging from coal delivery pipe 12 may be selectively directed upwardly into the furnace as an upper coal-air stream. Similarly, by tilting the lower coal nozzle downward a second portion of the primary air and pulverized coal mixture discharging from the coal delivery pipe 12 can be selectively directed downwardly into the furnace as a lower coal-air stream. Means 50 and 60 are provided for independently tilting the upper and lower nozzles of the split coal bucket 30.

In the preferred embodiment, an upper air nozzle 40 is rigidly mounted on the upper surface of the upper coal nozzle 32 to provide an upper air pathway 42 for directing a first portion of the secondary air passing from the secondary air conduit 14 into the furnace along the path essentially parallel to the upper coal-air stream. Similarly, a lower air nozzle 44 is rigidly mounted to the bottom surface of the lower coal nozzle 34 to provide a lower air pathway 46 for directing a second portion of the secondary air passing from the secondary air conduit 14 into the furnace along a path essentially parallel to the lower coal-air stream. Additionally, lateral air pathways 48 are provided on the sides of both the upper coal nozzle 32 and the lower coal nozzle 34 for directing the remainder of the secondary air into the furnace along a path flanking and essentially parallel to the upper and lower coal-air streams. Further, barrier plates 52 are suspended from the bottom of the upper coal nozzle 32 into the lateral air pathways 48 of the lower coal nozzle 34 in order to prevent the secondary air from entering the low pressure zone established between the upper and lower coal-air streams when the upper and lower coal nozzles are tilted apart.

Figure 6:
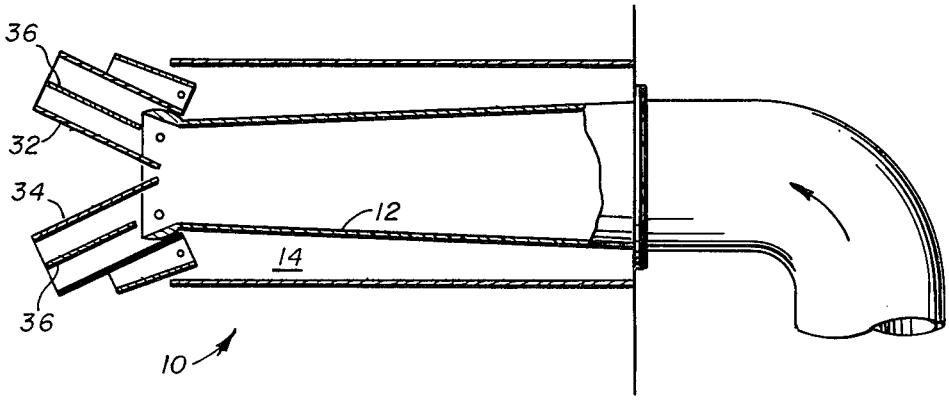
FIG. 6 is an end view taken along line 6—6 of FIG. 5 of the split coal bucket of the present invention.

Also disposed within the upper coal nozzle 32 and the lower coal nozzle 34 are flow baffles 36 and 38 respectively. Flow baffle 36 comprises a foreshortened flat plate aligned substantially parallel to the direction of the flow through the upper coal nozzle 32 thereby defining within the upper coal nozzle 32 an upper flow channel 54 and a lower flow channel 56. When the upper coal nozzle is tilted upward, as shown in FIG. 6, the flow baffle 36 causes a major portion of the pulverized coal and primary air entering the upper coal nozzle 32 to flow through the lower flow channel 56. Similarly, the flow baffle 38 comprises a foreshortened flat plate aligned substantially parallel to the direction of flow through the lower coal nozzle 34 thereby defining within the lower coal nozzle 34 an upper flow channel 55 and a lower flow channel 57. When the lower coal nozzle is tilted downward, the flow baffle 38 causes a major portion of the pulverized coal and primary air entering the lower coal nozzle 34 to flow through the upper channel 55. So disposed, flow baffles 36 and 38 do not in any way affect the flow of the primary air-pulverized coal stream through coal nozzles 32 and 34 when said nozzles are orientated parallel to the longitudinal axis of the coal delivery pipe 12, as is typical at high loads. However, during load operation when at least one of the cozl nozzles 32 and 34 is tilted away from the longitudinal axis of the coal delivery pipe 12, the corresponding flow baffle causes a major portion of the primary air-pulverized coal stream passing therethrough to flow through the flow channel bordering upon the lower pressure ignition stabilizing zone.

The typical prior art coal bucket comprises a single coal nozzle 28, having one or more extended rather than foreshortened baffle plates, surrounded by air pathways as in the present invention. The pulverized coal and primary air passing through the coal delivery pipe was discharged into the furnace through the single coal nozzle as a single coal-air stream. As indicated earlier, when the furnace was operated at low load, ignition became unstable; and supplemental fuel such as natural gas or oil had to be fired in order to provide sufficient additional energy to stabilize the ignition of the single coal-air stream.

Figure 5:
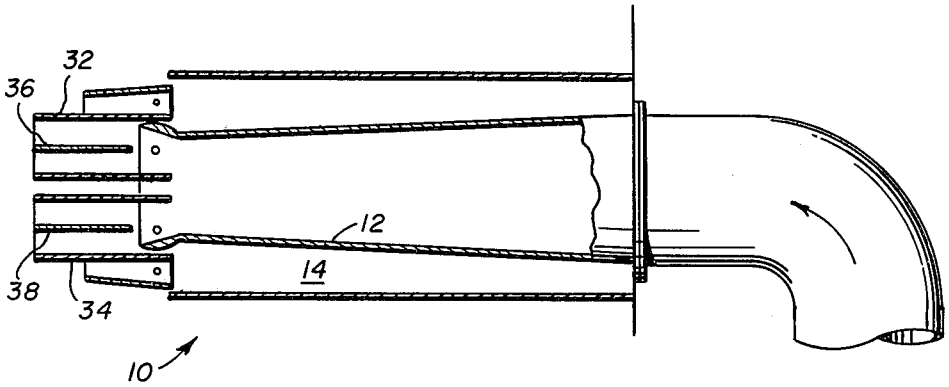
FIG. 5 is an enlarged cross-sectional view taken along line 5—5 of FIG. 6 of the split coal bucket of the present invention.

In accordance with the present invention, stable ignition at low loads is insured by providing a split coal bucket having independently tiltable upper and lower coal nozzles. In normal operation at higher ratings where ignition stability is not a problem, the upper and lower coal nozzles are disposed parallel to each other as shown in FIG. 5. In this configuration, the pulverized coal and primary air discharged from the coal delivery pipe 12 is effectively introduced into the furnace as a single coal-air stream, albeit a first portion is directed through the upper coal nozzle 32, a second portion through the lower coal nozzle 34, and a third portion through the gap therebetween. Thus, at these higher loads the flame pattern established is essentially identical to that associated with the single coal bucket of the prior art, and the characteristics of the tangential firing method are maintained.

Figure 7:
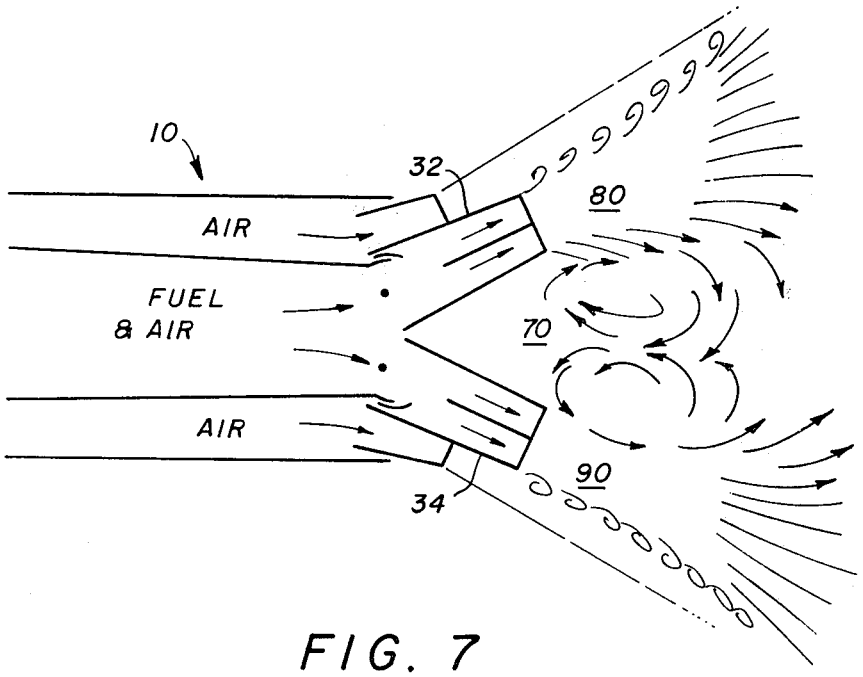
FIG. 7 is a diagrammatic elevational illustration of a fuel-air admission assembly equipped with the split coal bucket of the present invention showing the flame shape and recirculation pattern established during low load operation with the coal nozzles tilted apart.

However, when the furnace is operated at low loads, the upper coal nozzle 32 is tilted upward and the lower coal nozzle 34 is tilted downward as shown in FIG. 6. The pulverized coal and the primary air discharged from the coal delivery pipe 12 through the coal bucket is split into an upper coal-air stream 80 and a lower coal-air stream 90. As illustrated in FIG. 7, the upper coal-air stream 80 is directed upward through the upper coal 32 as it is introduced into the furnace and the lower coal-air stream 90 is directed downward through the lower coal nozzle 34 as it is introduced into the furnace. A low pressure zone 70, which serves as an ignition stabilizing region, is created between the diverging upper and lower coal-air streams. Air and coal and coal particles are drawn into the low pressure region 70 from the lower surface of the upper coal-air stream 80 and the upper surface of the lower coal-air stream 90 and ignited. The ignition is stabilized because a portion of the hot combustion products formed during ignition are recirculated within this low pressure ignition stabilizing zone 70, thereby providing the necessary ignition energy for igniting coal particles which are subsequently drawn into the region from the upper and lower coal-air streams.

Stable ignition is further insured because the fuel-air ratio within the ignition stabilizing zone 70 is increased which in turn reduces the amount of energy necessary to initiate ignition. As the pulverized coal and primary air discharging from coal delivery pipe 12 is split and a first portion is turned upward through the upper coal nozzle 32, the coal tends to concentrate along the lower surface of the upper coal nozzle 32 because of the density differential between the coal particles and the air molecules resulting in the coal particles being thrown outward by centrifugal force as the coal-air stream 80 turns upward through the upper coal nozzle 32. Similarly, the coal in the lower coal-air stream 90 is concentrated along the upper surface of the lower coal nozzle 34 as the coal-air stream 90 is turned downward through coal air nozzle 34. Thus, the coal is concentrated along the lower surface of the upper coal-air stream 80 and along the upper surface of the lower coal-air stream 90, i.e., along the surfaces of the streams which border upon the lower pressure ignition stabilizing zone 70. Consequently, these concentrated coal-air streams are drawn in to ignition stabilizing zone 70, which results in the fuel-air ratio in ignition zone 70 being increased above that which would be present at these low loads when operating with a single coal-air stream as in the prior art.

This novel split nozzle low load coal bucket design stabilizes ignition to an extent which heretofore could not be obtained during the low load operation of pulverized coal-fired furnaces without firing supplemental fuel such as natural gas or oil. Tests conducted on a 75 MW tangentially-fired pulverized coal unit retrofitted with the split nozzle low load coal bucket of the present invention for experimental purposes confirmed this statement. Before the unit was retrofitted with the new low load coal bucket, stable ignition without the use of auxiliary fuel was possible only at loads above approximately 40 percent. With the use of the low load coal bucket as described herein, the regime of stable ignition without the use of auxiliary fuel was extended down to 25 percent load. Such an extension of the stable ignition regime on coal-firing will greatly increase the flexibility of coal-fired steam generator operation and significantly reduce the consumption of oil and natural gas on coal-fired units.

Although described and illustrated hereinabove in terms of an upper and lower nozzle, the split coal bucket of the present invention contemplates split coal buckets with the nozzles arranged in other configurations, such as side by side, so long as at least one of the nozzles may be independently tilted away from the longitudinal axis of the coal delivery pipe.

What is claimed is:

1. In a fuel-air admission assembly having a coal delivery pipe for discharging a mixture of primary air and pulverized coal into a furnace in a stream parallel to its longitudinal axis, and a secondary air conduit surrounding said coal delivery pipe for passing secondary air into the furnace as a stream surrounding the primary air-pulverized coal stream, the improvement comprising:

a. a first coal nozzle pivotally mounted to said coal delivery pipe, said first coal nozzle being tiltable about an axis transverse to the longitudinal axis of said coal delivery pipe so that a first portion of the primary air and pulverized coal mixture discharging from said coal delivery pipe may be selectively directed through said first coal nozzle into the furnace as a first coal-primary air stream;

b. a second coal nozzle pivotally mounted to said coal delivery pipe, said second coal nozzle being tiltable about an axis transverse to the longitudinal axis of said coal delivery pipe so that a second portion of the primary air and pulverized coal mixture discharging from said coal delivery pipe may be selectively directed through said second coal nozzle into the furnace as a second coal-primary air stream, and c. means for tilting said first and said second coal nozzles independently of each other so as to selectively and independently direct the first and second coal-primary air streams into the furnace at an angle to the longitudinal axis of said coal delivery pipe.

2. In a fuel-air admission assembly having a coal delivery pipe for discharging a mixture of primary air and pulverized coal into a furnace in a stream parallel to its longitudinal axis, and a secondary air conduit surrounding said coal delivery pipe for passing secondary air into the furnace as a stream surrounding the primary air-pulverized coal stream, the improvement comprising:

a. an upper coal nozzle pivotally mounted to said coal delivery pipe, said upper coal nozzle being tiltable about an axis transverse to the longitudinal axis of said coal delivery pipe so that a first portion of the primary air and pulverized coal mixture discharging from said coal delivery pipe may be selectively directed through said upper coal nozzle into the furnace as an upper coal-primary air stream;

b. a lower coal nozzle pivotally mounted to said coal delivery pipe, said lower coal nozzle being tiltable about an axis transverse to the longitudinal axis of said coal delivery pipe so that a second portion of the primary air and pulverized coal mixture discharging from said coal delivery pipe may be selectively directed through said lower coal nozzle into the furnace as a lower coal-primary air stream; and c. means for tilting said upper and said lower coal nozzles independently of each other so as to selectively direct the upper and lower coal-primary air streams into the furnace at an angle to the longitudinal axis of said coal delivery pipe.

3. An improved apparatus as recited in claim 2, further comprising:

a. a flow baffle disposed within said upper coal nozzle parallel to the direction of the flow so as to define an upper and lower flow channel therethrough, said flow baffle being arranged within said upper coal nozzle so as to cause a major portion of the pulverized coal and primary air mixture to flow through the lower flow channel when the upper coal nozzle is tilted upward; and b. a flow baffle disposed within said lower coal nozzle parallel to the direction of the flow so as to define an upper and lower flow channel therethrough, said flow baffle being arranged within said upper coal nozzle so as to cause a major portion of the pulverized coal and primary air mixture to flow through the upper flow channel when the lower coal nozzle is tilted downward.

4. An improved apparatus as recited in claim 3, further comprising:

a. an upper air nozzle rigidly mounted to said upper coal nozzle for directing a first portion of the secondary air passing from said secondary air conduit into the furnace along a path essentially parallel to said upper coal-air stream; and b. a lower air nozzle rigidly mounted to said lower coal nozzle for directing a second portion of the seondary air passing from said secondary air conduit into the furnace along a path essentially parallel to said lower coal-air stream.

* * * * *

UNITED STATES PATENT OFFICE

CERTIFICATE OF CORRECTION

Patent No. 4,252,069 Dated February 24, 1981

Inventor(s) Michael S. McCartney

It is certified that error appears in the above-identified patent and that said Letters Patent are hereby corrected as shown below:

Column 4, line 62, change "lower" to --low--.

Column 5, line 67, change "lower" to --low--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*